US009637976B2

(12) United States Patent
Lorenson et al.

(10) Patent No.: US 9,637,976 B2
(45) Date of Patent: May 2, 2017

(54) DOWNHOLE DRILLING TOOL

(71) Applicants: TLL Oilfield Consulting Ltd., Edmonton (CA); Acura Machine Inc., Edmonton (CA)

(72) Inventors: Troy Lorenson, Edmonton (CA); Dave Nicholson, Edmonton (CA); Petr Macek, Sherwood Park (CA)

(73) Assignee: TLL OILFIELD CONSULTING LTD., Edmonton (CA)

( * ) Notice: Subject to any disclaimer, the term of this patent is extended or adjusted under 35 U.S.C. 154(b) by 310 days.

(21) Appl. No.: 14/153,646

(22) Filed: Jan. 13, 2014

(65) Prior Publication Data

US 2014/0246240 A1 Sep. 4, 2014

Related U.S. Application Data

(60) Provisional application No. 61/737,050, filed on Dec. 13, 2012.

(51) Int. Cl.
*E21B 7/24* (2006.01)
*E21B 4/02* (2006.01)
(Continued)

(52) U.S. Cl.
CPC ..... *E21B 4/02* (2013.01); *E21B 7/065* (2013.01); *E21B 21/10* (2013.01)

(58) Field of Classification Search
CPC ... E21B 7/24; E21B 4/02; E21B 21/10; E21B 4/14; E21B 28/00; E21B 6/02; E21B 6/04;
(Continued)

(56) References Cited

U.S. PATENT DOCUMENTS 2,250,912 A 7/1941 Hudson et al.
2,329,912 A * 9/1943 Kent ..... F04B 1/18 91/505
(Continued)

FOREIGN PATENT DOCUMENTS

CA 2255065 C 1/2007
CA 2312341 C 8/2007
(Continued)

OTHER PUBLICATIONS

International Search Report dated Feb. 23, 2015 from PCT/CA2014/051155, 3 pgs.
(Continued)

*Primary Examiner* — Kipp Wallace
(74) *Attorney, Agent, or Firm* — Wilson Lue LLP; Jenna L. Wilson

(57) ABSTRACT

A directional drilling tool includes a housing defining a central cavity for enabling the transmission of drilling fluid through the drill string. A motor contained in the housing includes a rotor-stator assembly, and produces eccentric motion of the rotor. An inverter or shock absorbing assembly disposed along the housing upstream from the motor functions to expend and contract the central cavity in response to fluid pressure changes produced by the drilling fluid flow. A valve assembly, comprising a multi-port flow head that rotates under influence of the motor and a multi-port flow restrictor, creates a varying pattern of pressure spikes in the drilling fluid as the ports of the flow head move into and out of alignment with the ports of the flow restrictor, which in turn induces a percussive effect and axial movement in the drill string.

20 Claims, 5 Drawing Sheets

(51) Int. Cl.
*E21B 21/10* (2006.01)
*E21B 7/06* (2006.01)

(58) Field of Classification Search
CPC .. E21B 6/00; E21B 7/06; F04C 13/008; F04C 2270/12; F16K 11/074; F16K 11/0743; F16K 11/0746; F16K 3/08; F16K 3/085
See application file for complete search history.

(56) References Cited

U.S. PATENT DOCUMENTS

| | | | | |
|---|---|---|---|---|
| 2,738,956 | A | 3/1956 | Bielstein | |
| 2,743,083 | A | 4/1956 | Zublin | |
| 2,746,721 | A | 5/1956 | Moore | |
| 2,780,438 | A | 2/1957 | Bielstein | |
| 2,896,916 | A | 7/1959 | Clavier et al. | |
| 2,942,851 | A | 6/1960 | Beck | |
| 3,096,833 | A | 7/1963 | Bodine | |
| 3,216,514 | A | 11/1965 | Nelson | |
| 3,243,001 | A * | 3/1966 | Vincent | E21B 7/062 175/73 |
| 3,270,822 | A | 9/1966 | Cleary | |
| 3,640,351 | A | 2/1972 | Coyne et al. | |
| 3,894,818 | A | 7/1975 | Tschirky | |
| 3,899,033 | A | 8/1975 | Van Huisen | |
| 3,933,209 | A | 1/1976 | Sweeney | |
| 3,941,196 | A | 3/1976 | Curington et al. | |
| 4,080,115 | A | 3/1978 | Sims et al. | |
| 4,384,625 | A | 5/1983 | Roper et al. | |
| 4,817,739 | A | 4/1989 | Jeter | |
| 4,819,745 | A | 4/1989 | Walter | |
| 4,830,122 | A | 5/1989 | Walter | |
| 4,890,682 | A | 1/1990 | Worrall et al. | |
| 4,953,595 | A | 9/1990 | Kotlyar | |
| 4,979,577 | A | 12/1990 | Walter | |
| 5,009,272 | A | 4/1991 | Walter | |
| 5,048,622 | A | 9/1991 | Ide | |
| 5,139,400 | A | 8/1992 | Ide | |
| 5,176,164 | A * | 1/1993 | Boyle | E21B 34/06 137/155 |
| 5,186,614 | A * | 2/1993 | Abousabha | F04B 27/0895 181/403 |
| 5,190,114 | A | 3/1993 | Walter | |
| 5,513,713 | A * | 5/1996 | Groves | E21B 7/065 175/61 |
| 5,662,180 | A | 9/1997 | Coffman et al. | |
| 6,199,586 | B1 * | 3/2001 | Pawelzik | E03C 1/04 137/625.17 |
| 6,279,670 | B1 * | 8/2001 | Eddison | E21B 4/02 175/107 |
| 8,535,028 | B2 * | 9/2013 | Groves | F01C 1/10 166/104 |
| 2006/0272821 | A1 * | 12/2006 | Webb | E21B 7/18 166/305.1 |
| 2010/0018201 | A1 * | 1/2010 | Mochizuki | F16H 39/14 60/487 |
| 2013/0277116 | A1 * | 10/2013 | Knull | E21B 4/003 175/57 |
| 2014/0041943 | A1 * | 2/2014 | Lanning | E21B 4/02 175/57 |
| 2014/0190749 | A1 * | 7/2014 | Lorenson | E21B 21/10 175/51 |

FOREIGN PATENT DOCUMENTS

| | | | |
|---|---|---|---|
| CA | 2680895 | A1 | 3/2011 |
| CA | 2487380 | C | 2/2013 |
| EP | 0335543 | A1 | 10/1989 |
| GB | 2059481 | A | 4/1981 |
| WO | 9416189 | A1 | 7/1994 |
| WO | 2012138383 | A2 | 10/2012 |

OTHER PUBLICATIONS

Examination Report dated Apr. 23, 2015 from CA2872736, 3 pgs.
Drill on Target Directional Services Inc., "Drill on Target: Advanced Drilling Solutions", published at least as early as Aug. 20, 2015, 5 pgs.
Wedel, Ryan et al., "Mitigating Bit-Related Stick-Slip With a Torsional Impact Hammer", 2011 AADE National Technical Conference and Exhibition held at the Hilton Houston North Hotel, Houston, Texas, Apr. 12-14, 2011, 5 pgs.
Powell, Scott et al., "Fluid Hammer Increases PDC Performance through Axial and Torsional Energy at the Bit", SPE 166433, SPE Annual Technical Conference and Exhibition, New Orleans, Louisiana, USA, Sep. 30-Oct. 2, 2013, pp. 1-7.

* cited by examiner

DOWNHOLE DRILLING TOOL

CROSS-REFERENCE TO RELATED APPLICATIONS

This application claims priority to U.S. Provisional Application No. 61/737,050 filed Dec. 13, 2012, the entirety of which is incorporated herein by reference.

TECHNICAL FIELD

The present invention relates to drilling tools, and in particular to down hole drilling assemblies for use in oil and gas recovery applications.

TECHNICAL BACKGROUND

In oil and gas production and exploration, downhole drilling through rock can be accomplished with a downhole drill through which drilling fluid, conventionally referred to as drilling mud, is pumped. The drilling fluid assists in the drilling process by, for example, dislodging and removing drill cuttings, cooling the drill bit, and/or providing pressure to prevent formation fluids from entering the wellbore.

Application of a vibrational and/or percussive effect, which can be accomplished through the regulation of drilling fluid flow, can improve the performance of the downhole drill. Examples of downhole assemblies providing such an effect include U.S. Pat. No. 2,780,438 issued to Bielstein, and Canadian Patent No. 2,255,065.

BRIEF DESCRIPTION OF THE DRAWINGS

In drawings which illustrate by way of example only embodiments of the present disclosure, in which like reference numerals describe similar items throughout the various figures.

Figure 1:
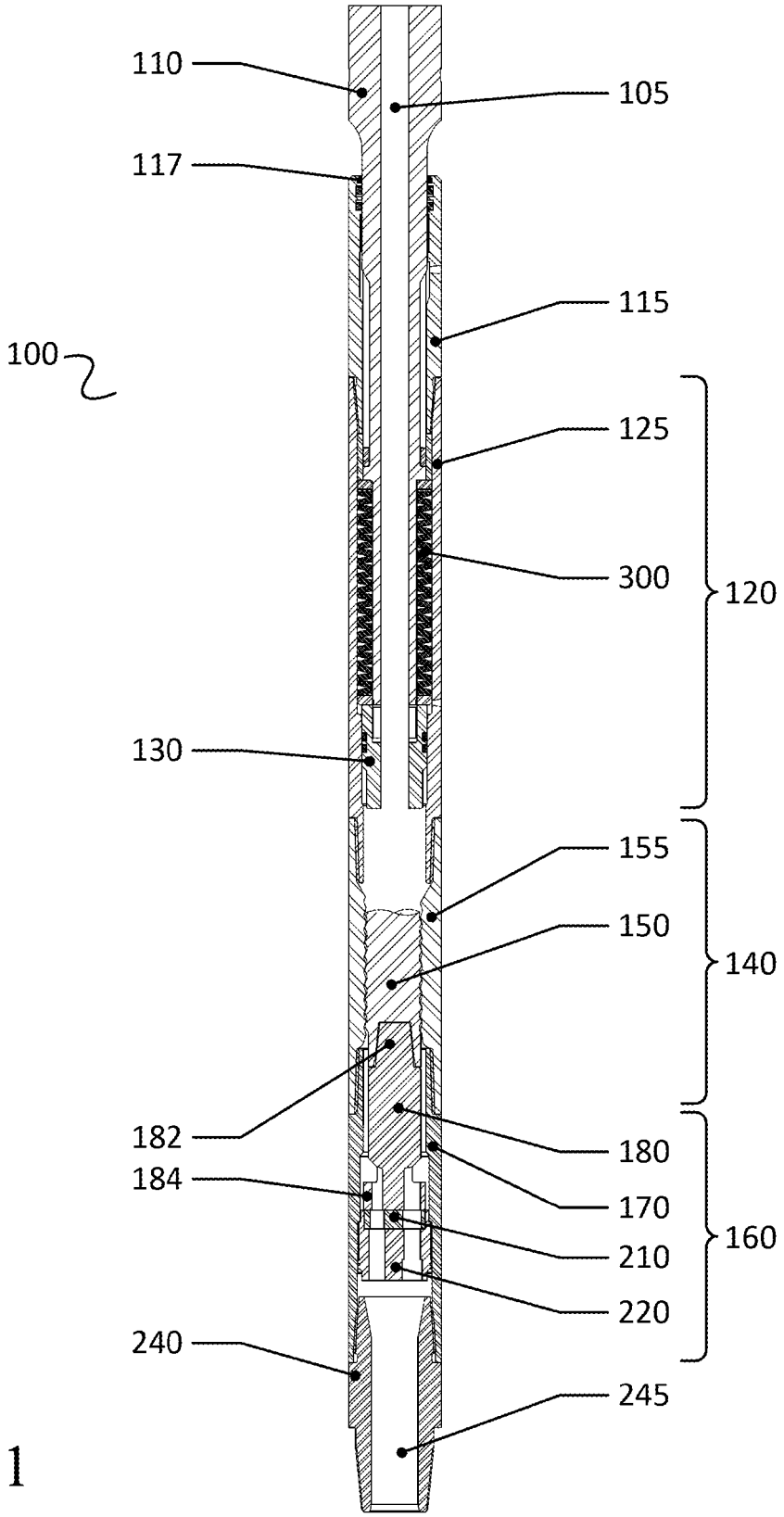
FIG. 1 is a lateral cross-sectional view of a drilling tool in accordance with one embodiment of the present invention.

In the drawings, preferred embodiments of the invention are illustrated by way of example. It is to be expressly understood that the description and drawings are only for the purpose of illustration and as an aid to understanding, and are not intended as a definition of the limits of the invention.

DETAILED DESCRIPTION

The present embodiments and examples provide a drilling fluid flow controlling downhole tool for controlling the flow of drilling fluid in a drill string, and components of the downhole tool. In one embodiment, there is described a directional drilling tool forming part of a drill string. The drilling tool includes a mandrel, and a housing extending from the mandrel, to define a central cavity for enabling the transmission of drilling fluid through the drill string. A motor, such as a positive displacement motor or turbine driven assembly, is contained in the housing and includes a rotor-stator assembly in a multi-lobe arrangement, the motor for producing an eccentric motion of the rotor. An inverter is disposed along the drill string housing upstream from the motor and is capable of expanding and contracting the central cavity in response to fluid pressure changes produced by the drilling fluid flow. A multiport flow head depends from the rotor. The flow head comprises a plurality of ports on a face thereof, the plurality of ports for permitting the transmission of drilling fluid therethrough, the flow head adapted to rotate as the rotor rotates. A flow restrictor is affixed to the drill string housing downstream from the flow head and directly abutting the face of the flow head. The flow restrictor itself has a multi-port arrangement which includes a plurality of ports extending through the flow restrictor to permit transmission of drilling fluid therethrough. In operation, the rotation of the flow head on the flow restrictor creates pattern of pressure spikes within the central cavity as the ports of the flow head move into and out of alignment with the ports of the flow restrictor, which in turn causes the inverter to expand and contract in a corresponding pattern. Due to the eccentric motion induced in the flow head and the relative configurations of the ports in the flow head and the flow restrictor, the pattern of pressure spikes is polyrhythmic, and may be considered to be relatively arrhythmic compared to simpler flow restriction arrangements utilizing, for instance, a single-port configuration controlling drilling fluid flow.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

All terms used herein are used in accordance with their ordinary meanings unless the context or definition clearly indicates otherwise. Also, unless indicated otherwise except within the claims the use of "or" includes "and" and vice-versa. Non-limiting terms are not to be construed as limiting unless expressly stated or the context clearly indicates otherwise (for example, "including", "having", "characterized by" and "comprising" typically indicate "including without limitation"). Singular forms included in the claims such as "a", "an" and "the" include the plural reference unless expressly stated or the context clearly indicates otherwise. Terms such as "may" and "can" are used interchangeably and use of any particular term should not be construed as limiting the scope or requiring experimentation to implement the claimed subject matter or embodiments described herein. Further, it will be appreciated by those skilled in the art that other variations of the preferred embodiments described herein may also be practiced without departing from the scope of the invention.

Referring to FIG. 1, there is shown a cross section of a drilling tool 100 within a drill string, in accordance with one embodiment of the present invention. The drilling tool 100 described herein forms part of a drill string (not all of which is shown in the accompanying drawings) for use in down hole drilling applications, and in particular directional or horizontal well drilling, in which wells are laterally displaced from the surface drilling location. The tool 100 described herein is assembled from a number of discrete components and sections; however, as will be appreciated by those skilled in the art, some of the components and sections described herein may be constructed as a single unit and/or contained within a unitary housing. In drilling operations, fluid, such as drilling mud, is delivered through a flowbore of a drill string to a drill bit disposed at a distal end of the drill string. The tool 100 provides fluid communication from an upstream end of the drill string to the drilling components mounted below the tool 100.

The tool 100 is mounted on the drill string via a mandrel 110. The mandrel 110 defines part of a shaft 105 that receives drilling fluid and provides fluid communication with a motor 140, discussed below. The upper end of the mandrel 110 may be coupled to a drill pipe (not shown), while the lower end of the mandrel 110 is received within an upper housing 115 and extends through the upper housing into an inverter section 120. The upper housing 115 may serve as an adaptor to position the mandrel 110 within the inverter section 120. Sealing contact between the upper housing 115 and the mandrel 110 in this example is provided with a wiper and/or seals 117 positioned around the mandrel 110. The inverter section 120 may be, or may function as, a shock sub in the drill string.

The inverter section 120 comprises a housing 125, housing an inverter assembly 300. In the embodiment shown in FIG. 1, the inverter assembly 300 is retained in an annular shaped conduit which surrounds a portion of the shaft 105. The mandrel 110 terminates with a piston 130 positioned below the inverter assembly 300. The piston 130 is sized to travel axially within the interior diameter of the housing 125 under influence of the inverter assembly 300. The inverter section 120 is disposed in fluid communication with the motor 140 via the piston 130, and is capable of expanding and contracting the volume of the shaft 105 in response to fluid pressure changes exerted on the inverter assembly 300 by operation of the downstream motor 140, explained in greater detail below. The inverter assembly 300 may comprise a mechanical spring assembly, or equivalent means, which stores energy in response to an increase in fluid pressure within the shaft 105, and releases the stored energy in response to a decrease in fluid pressure within the shaft 105.

As mentioned above, the shaft 105 defined by the mandrel 110 and the inverter assembly 120 receives drilling fluid and is in communication with a motor 140. The motor 140 may be a positive displacement motor comprising a rotor 150 disposed within a stator 155, such that the rotor 150 rotates within the stator 155. In the example shown in FIGS. 1 and 2, the stator 155 is integral with a housing that is connected to the inverter housing 125, although the stator 155 may be a component housed within a separate motor housing. Each of the rotor 150 and stator 155 has a multi-lobe configuration in an unequal ratio, such as a 7:8 lobe ratio, although other lobe ratios such as 4:5 and 5:6 may be utilized. As those skilled in the art will understand, the unequal lobe arrangement of the stator 155 and rotor 150 results in a staggered eccentric motion of the rotor 150 vis-a-vis the stator 155 when motion is induced in the rotor 150 during operation.

Figure 2:
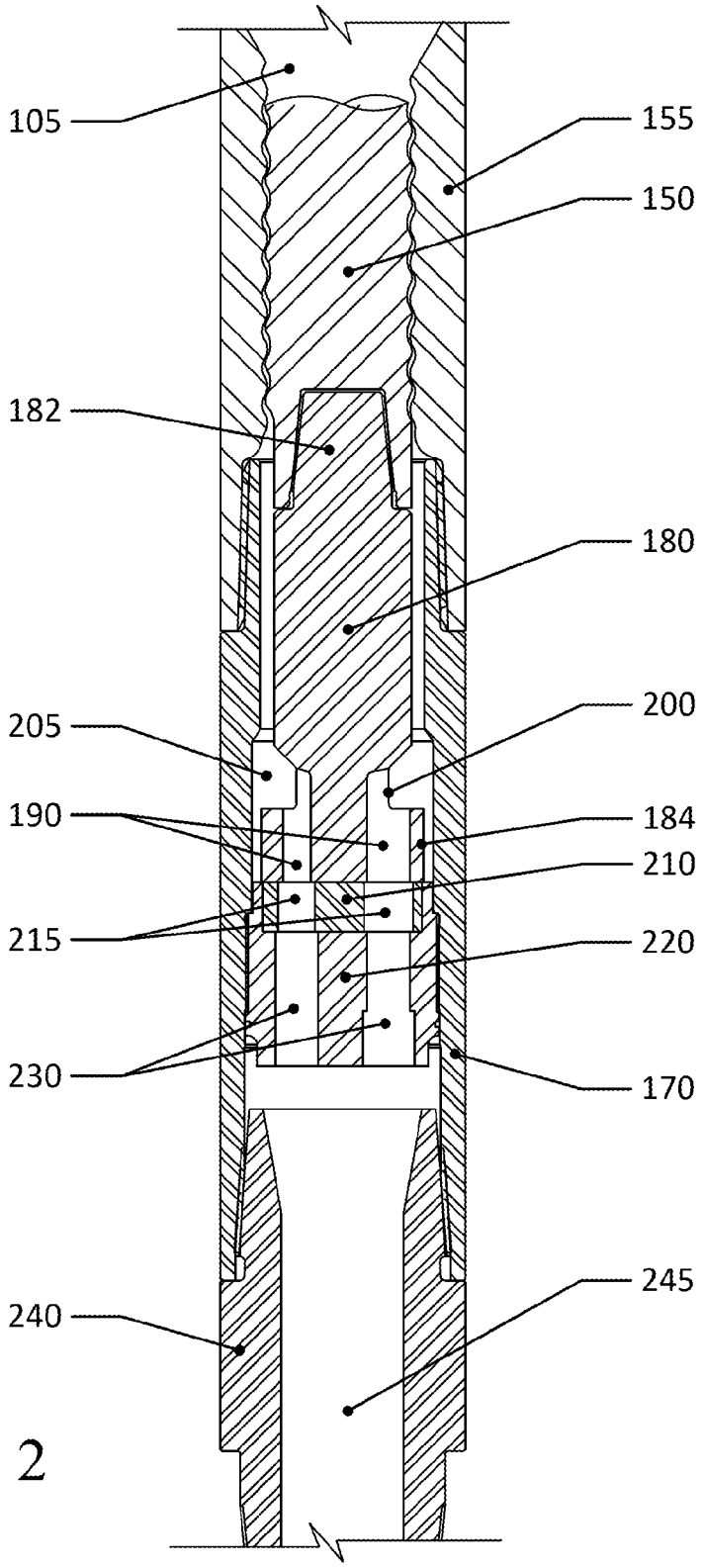
FIG. 2 is a lateral cross-sectional view of a segment of the drilling tool shown in FIG. 1.

A valve section 160 is provided downstream from the motor 140. In the example of FIGS. 1 and 2, the valve section 160 includes a housing 170, a multi-port flow head 180 positioned within a valve housing 170, and a flow restrictor 220 with an optional insert 210 interposed between the flow head 180 and the flow restrictor 220. The flow head 180 comprises a plurality of ports 190 and is secured to the rotor 150 at a first end 182, for example by a suitable male/female engagement, or equivalent means, or by coupling via a drive shaft (not shown). In the example implementation, the flow head 180 is a separate component from the rotor 150; the first end 182 is adapted as necessary to couple with the rotor 150. In another implementation, the flow head 180 may be formed integrally with the rotor 150.

Figure 3:
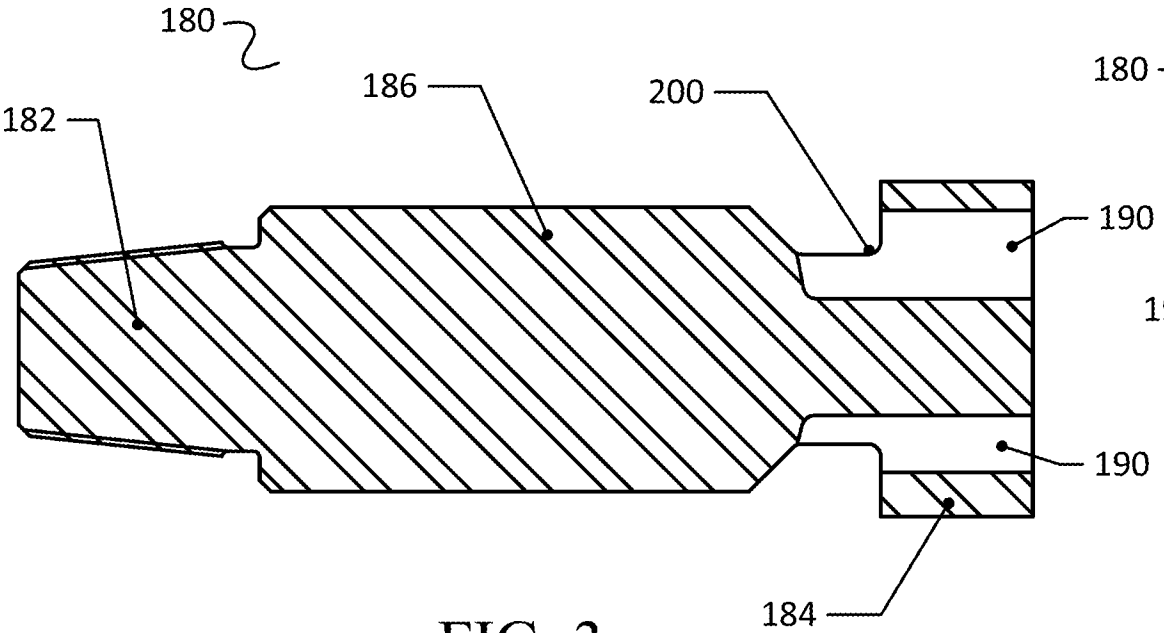
FIG. 3 is a lateral cross-sectional view of a multi-port flow head in accordance with one embodiment of the present invention.

As can be seen in FIGS. 2 and 3, the first end 182 is provided at one end of a body 186 of the flow head 180. The body 186 terminates at a collar 200 which joins the body 186 with the second end 184. In the illustrated example, the first end 182, body 186, and second end 184 are integrally formed. The second end 184, which in this example is generally circular in profile, includes a number of ports 190 extending therethrough. The outer diameter of the collar 200 is smaller than the outer diameter of both the body 186 and the second end 184, with the result that when in place in the valve section 160, an annular chamber 205 (indicated in FIG. 2) is defined by the external contours of the flow head 180 and the internal contour of the valve housing 170. In FIGS. 1 and 2, it can be seen that the motor 140 is in fluid communication with the chamber 205 and the ports 190 of the flow head 180, and that the chamber 205 can receive drilling fluid as it flows from the motor 140 towards the ports 190 of the flow head 180.

Figure 4:
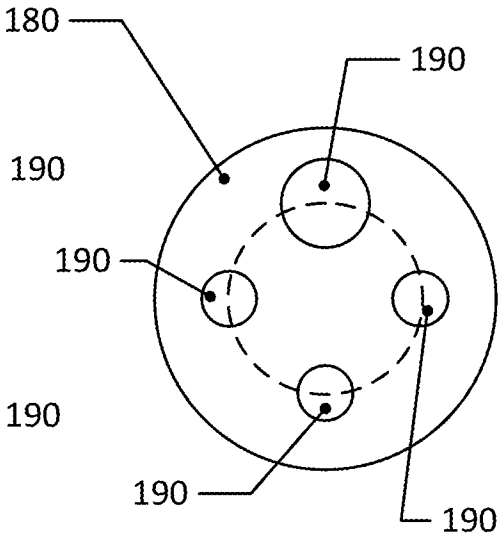
FIG. 4 is a cross-sectional view of a port end of the multi-port flow head of FIG. 3.

Turning to FIGS. 3 and 4, four ports 190 of two different sizes are provided in the second end 184 of the flow head 180. The ports 190 extend in a direction substantially parallel to the axis of the flow head 180 and are preferably substantially cylindrical, or are otherwise curvilinear in shape such that a continuous interior wall is formed within each port 190, so as to facilitate fluid flow and discourage mud build-up on the interior port walls. In this example, the ports 190 are generally regularly distributed around the center of the second end 184 with the centers of the ports 190 being a substantially equal distance from the center of the flow head 180, and with pairs of ports 190 being diametrically aligned. It will be appreciated from the examples described herein that the configuration of the ports 190 may vary from the example depicted in the accompanying drawings by number, size, positioning, shape or profile, or by a combination of two or more of these factors. Variations in the configuration of the ports 190 may be determined in part based on drilling fluid weight and/or desired fluid pressure within the tool 100. As will be appreciated from the discussion of the operation of the tool 100 below, more or less than four ports 190 may be provided, but it is preferable to utilize at least two ports 190 of at least two different sizes to provide sufficient drilling fluid flow variation.

Returning to FIGS. 1 and 2, a flow restrictor 220 is positioned within the valve housing 170, adjacent or proximate to the flow head 180, and downstream from the motor 140. The flow restrictor 220 may be coupled to the interior of the valve housing 170 by threaded engagement. In operation, the flow head 180 is rotated in eccentric rotation by the rotor 150, and the flow restrictor 220 remains stationary with respect to the flow head 180 and rotor 150.

Figure 6:
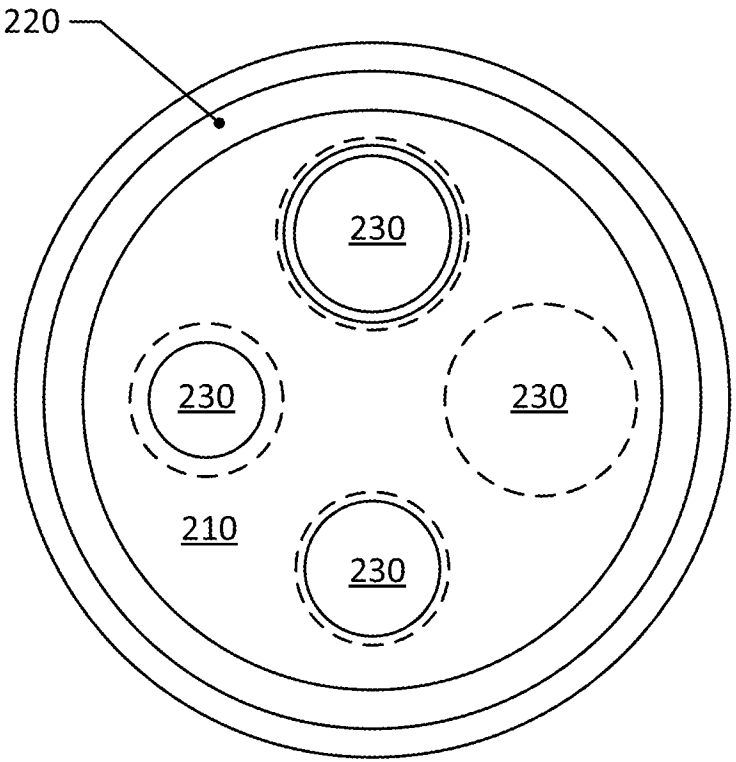
FIG. 6 is a top plan view of the flow restrictor and insert of FIG. 5.
Figure 5:
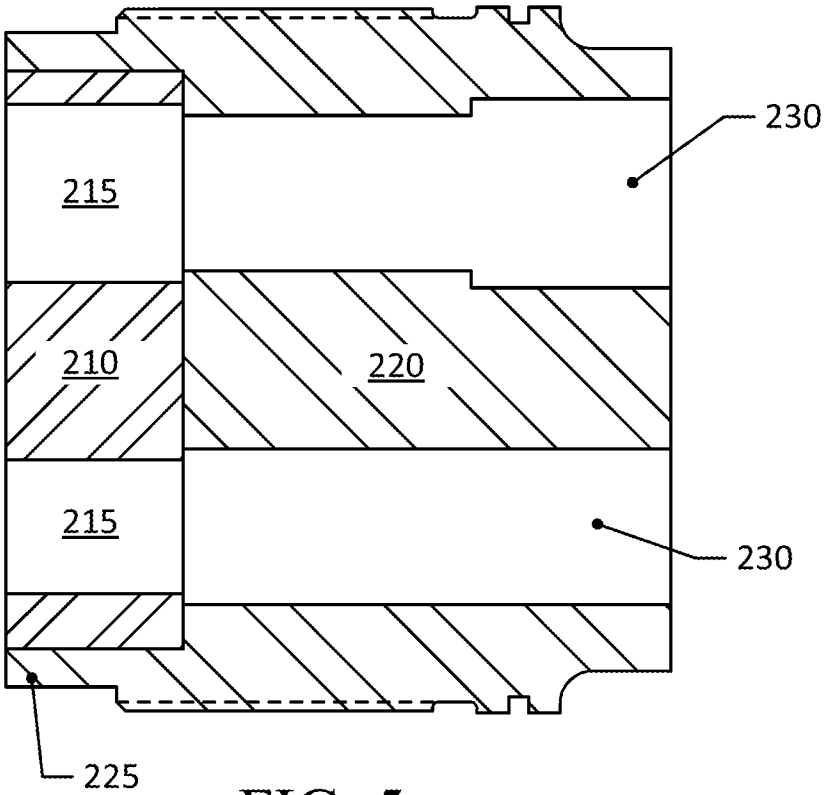
FIG. 5 is a lateral cross-sectional view of a flow restrictor and insert in accordance with one embodiment of the present invention.

In the embodiment shown in FIG. 5, the flow restrictor 220 is a substantially cylindrical component with a plurality of ports 230 extending therethrough that are generally parallel to the component's axis, and in this example, generally equally spaced from the flow restrictor 220's center. The ports 230 are preferably cylindrical or at least generally curvilinear in shape. The flow restrictor 220 includes at least two ports 230 of at least two different sizes, as with the ports 190 of the flow head 180. In FIG. 6, three ports 230 are shown, where two ports are substantially equal in diameter and a third is of a larger diameter. While the flow restrictor 220 could include four or even more ports 230, in the illustrated example of FIG. 6, the fourth port 230 (shown in phantom) is completely closed off by use of a plug or hardened insert. This plug may be removable so as to make the fourth port 230 available. Again, as with the flow head 180, the number, size, positioning, and/or shape or profile of the ports 230 can be varied as described above. In the embodiments depicted in the drawings, the ports 190 and 230 range in diameter from approximately 9/16" to 13/16", though these stated diameters are exemplary and not meant to be limiting. To further give effect to the desired variations in drilling fluid flow, while the ports 190, 230 on the flow head 180 and flow restrictor 220 may be equally radially spaced apart on each component, the ports on one or both components are not in regular or diametric alignment with each other; for instance, rather than providing the ports 190, 230 angularly spaced at 90° or 180° as can be seen in FIGS. 4 and 6, on at least one component at least one port 190 or 230 is offset so that the spacing between it and an adjacent port is more or less than either 90° or 180°.

In one implementation, the second end 184 of the flow head 180 and an upper face of the flow restrictor 220 are positioned so that they are substantially in contact, with the effect that their respective faces may rub together as the flow restrictor 220 receives the thrust load generated by the motor 140. Thus, an insert 210 is also provided in a preferably wear-resistant material. A substantially cylindrical insert 210 is most clearly seen in FIGS. 2 and 5. Where the insert 210 is used, the flow restrictor 220 may be provided with a lip 225 around its upper face (i.e., the face that is adjacent or proximate to the flow head 180) defining a recess for receiving the insert 210. As can be seen in FIG. 5, the recess is sized so that the upper face of the lip 225 and the insert 210 are substantially flush. The flow head 190 may therefore ride on top of both the lip 225 and the insert 210 without substantial obstruction. The insert 210 is also provided with ports 215 that generally correspond to the ports 230 of the flow restrictor 220, but which may or may not substantially obstruct the ports 230. In the particular example shown in FIGS. 5 and 6, it can be seen that the ports 215 of the insert 210 correspond generally in shape, position and arrangement with the ports of the flow restrictor 220, but the dimensions of the ports 215 are not equal to the dimensions of their corresponding ports 230 in the flow restrictor 220. This can result in partial obstruction of a port 230 when the port 215 of the insert 210 is smaller than the corresponding port 230; however, it will be appreciated by those skilled in the art that the combination of the insert 210 and flow restrictor 220 can still have the desired flow varying effect. FIG. 6 is a top view of the insert 210 in place on the flow restrictor 220, and it can be seen that a substantial area of each of the three unblocked ports 230 is unobstructed. As the insert 210 may only modify the exposed area of the ports 230 but otherwise does not affect the function of the flow restrictor 220, the insert 210 can be considered to be part of the flow restrictor component of the tool 100. The flow head 180, flow restrictor 220, and the optional insert 210 may be considered to form part of a valve in the tool 100.

The valve housing 170 in turn may be connected to another component of the drill string, here indicated as lower sub 240. This component could be an adaptor for the drill bit of the drill string. Drilling fluid passing from the motor 140 and through the valve section 160 enters the shaft or other passage 245 defined in the lower sub 240. The passage 245 is thus in fluid communication with the shaft 105, subject to any flow variations imposed by the operation of the various components of the tool 100.

In operation, drilling fluid passes through the mandrel 110 and inverter section 120, and on through the motor 140. The drilling fluid is received in cavities defined by the rotor 150 and stator 155, causing the rotor 150 to turn in an eccentric motion. The motion of the rotor 150 is transferred to the multi-port flow head 180, which in turn rotates in an eccentric manner on the insert 210 and/or flow restrictor 220. As a result of the motion of the flow head 180, the ports 190 in the flow head 180 move into and out of alignment with the ports 215, 230 of the insert 210 and flow restrictor 220. The alignment can include only partial alignment, where only part of a given port 190 of the flow head 180 coincides with the ports 215 and 230 and the remainder of the port 190 is blocked by a solid region of the insert 210 and/or flow restrictor 220. In some cases the alignment may be a perfectly centered alignment where the center of a port 190 is aligned with the center of a port 215 and a corresponding port 230, although if the area of the port 215 or 230 is smaller than the area of the port 190, the port 190 will be partially blocked by the insert 210 or flow restrictor 220. When a flow head port 190 is in alignment with the ports 215, 230, fluid communication is permitted through at least that part of the port 190 that is not blocked. A port 190 is therefore not in alignment with a port 215, 230 when it is effectively completely blocked by the insert 210 and/or flow restrictor 220. The movement of the port 190 out of alignment with the ports 215, 230 thus constrains or restricts the drilling fluid flow through the port 190. As the port 190 moves into alignment with ports 215, 230, the flow through the port 190 increases. At the same time, other ports 190 may be moving out of or into alignment with other ports 215, 230 of the insert 210 and/or flow restrictor 220.

Figure 7:
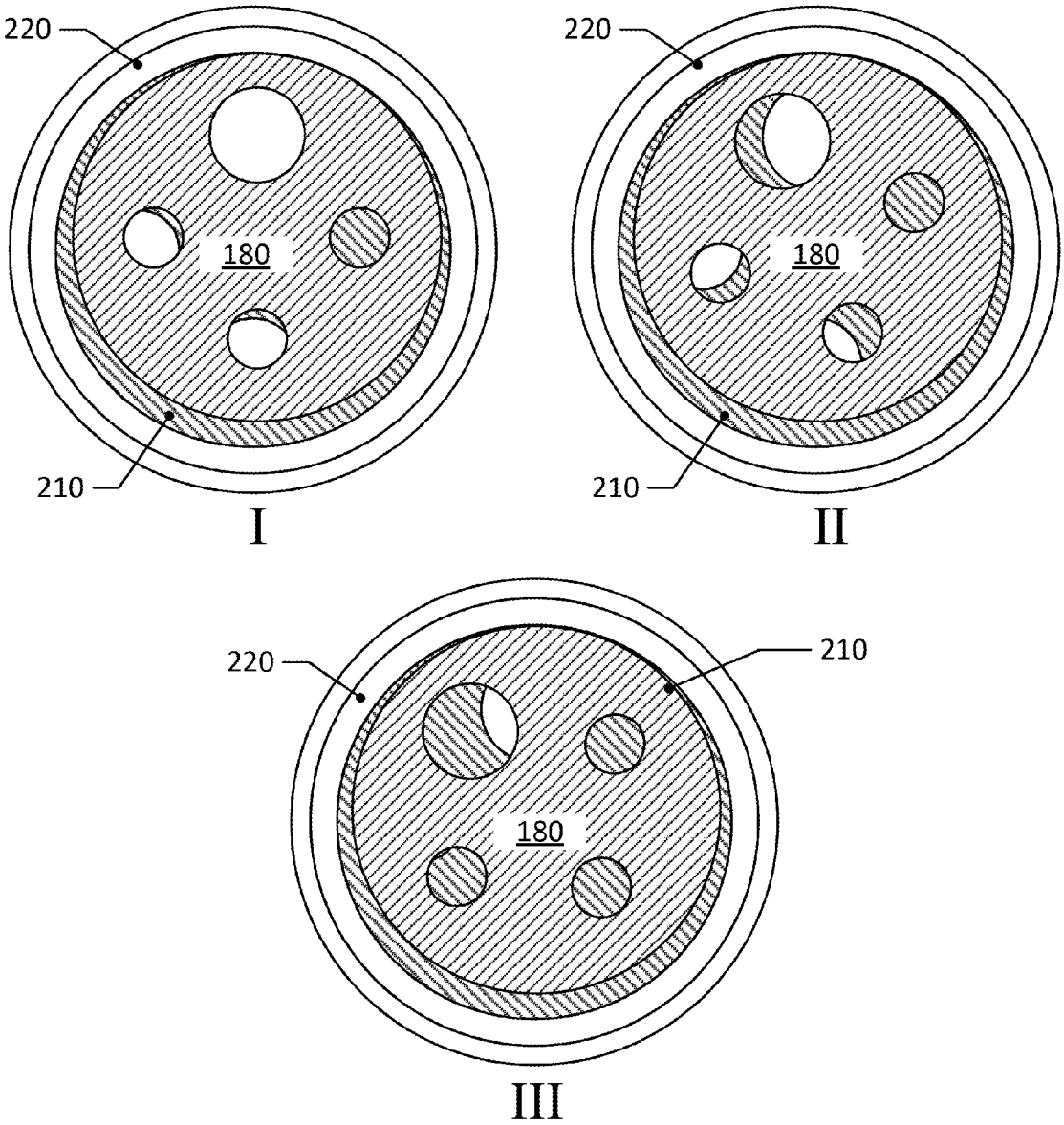
FIG. 7 provides axial cross-sectional views illustrating the alignment of ports in an example embodiment in operation.

In the examples shown in FIGS. 4 and 6, four ports 190 are provided in the flow head 180 and three ports 230 are provided are positioned on the flow restrictor 220 and the insert 210, an unequal, 4:3 ratio. Combined with the 7:8 lobe ratio between the rotor 150 and stator 155, a quasi-irregular effect is achieved, whereby consecutive cycles of the rotor 150 in the stator can result in a different orientation of the flow head 180 with respect to the flow restrictor 220 at a given position of the flow head 180 in the rotational cycle. This is illustrated in FIG. 7, which shows three example orientations I, II, and III of the flow head 180 from FIG. 4 superimposed on the flow restrictor 220 and insert 210 of FIGS. 5 and 6. These orientations are shown as examples only to demonstrate how the flow head 180 might be located in substantially the same position with respect to the flow restrictor 220, yet have a different orientation, with the result that the degree of alignment of each port 190 of the flow head 180 with ports 215, 230 of the insert 210 and/or flow restrictor 220 can vary in consecutive cycles. The combination of the varying orientation of the ports 190 and the rotation of the flow head 180, compounded by the configurations of the ports 190, 215 and/or 230, creates a flow rate through the valve section 160 that follows a complex, polyrhythmic pattern as the drilling fluid flows from the motor 140, through the valve section 160, and on to components of the drill string downstream from the valve section 160. The varying flow rate therefore includes multiple pressure spikes following this complex pattern within the shaft 105 and 245, causing responsive action from the inverter 300 and producing responsive axial movement in the drill string and a percussive effect when drilling.

The resultant complex, polyrhythmic pattern may be considered to be arrhythmic within a given cycle of the rotor 150 in the stator 155, depending on the particular configuration of the ports (i.e., the number, positions, sizes, and cross-sectional profiles) in the flow head 190 and the insert 210 and/or flow restrictor 220. As noted above, consecutive cycles of the rotor 150 in the stator can result in a different orientation of the flow head 180 with respect to the flow restrictor 220 at a given position of the flow head 180 in the rotational cycle; this may be considered to be irregular or arrhythmic as between the consecutive cycles of the rotor. The pattern of fluid flow and the consequential percussive effect can assist in preventing drill cuttings in the drilling fluid from settling in the drill string, freeing stuck objects from the wellbore during drilling. The resultant axial movement can also assist in freeing the drill bit or other components of the drilling string that may become stuck during drilling, by varying the tension along the drilling string. Generally, the fluid flow and pressure pattern resulting from operation of the tool 100 improves the overall effect and efficiency of directional drilling, and can potentially result in less drag and easier steering and penetration (with less force) of the drill bit, thereby allowing a greater drilling distance to be achieved with less exertion than would otherwise be required. With appropriate selection of the rotor/stator ratio and/or port configurations, the frequency of pressure spikes can be controlled and selected so as to reduce interference with measurement while drilling (MWD) or other equipment, compared to conventional directional drilling apparatuses, including other pulsing mechanisms. These selections may be influenced by the characteristics of the drilling fluid or other components used in the drilling operation. As explained above, the port configurations may be modified by changing the number, dimensions, and profiles of the ports; it may be noted, though, that it is most convenient to employ a circular profile (i.e., a cylindrical port), as this is most easily manufactured. The beneficial aspects of the present embodiments may be attained for both horizontal and vertical drilling operations.

In summary, a drilling tool includes a housing defining a central cavity for enabling the transmission of drilling fluid through the drill string. A motor contained in the housing includes a rotor-stator assembly, the motor producing eccentric motion of the rotor. An inverter or shock absorbing assembly disposed along the housing upstream from the motor functions to expend and contract the central cavity in response to fluid pressure changes produced by the drilling fluid flow. A valve assembly, comprising a multi-port flow head that rotates under influence of the motor and a multi-port flow restrictor, creates a varying pattern of pressure spikes in the drilling fluid as the ports of the flow head move into and out of alignment with the ports of the flow restrictor, which in turn induces a percussive effect and axial movement in the drill string.

While one or more embodiments of this invention have been illustrated in the accompanying drawings and described above, it will be evident to those skilled in the art that changes and modifications can be made therein without departing from the invention. For instance, the number, sizes, shapes, and areas of the ports in the flow head, insert, and flow restrictor described herein can be modified as appropriate to accomplish a desired effect, or to accommodate particular equipment or drilling fluid. The invention includes all such variations and modifications as fall within the scope of the appended claims.

The invention claimed is:

1. A drilling tool assembly for use in a drill string, the drilling tool assembly comprising:

a motor comprising an eccentrically-driven rotor;

a flow head comprising a plurality of ports permitting fluid communication therethrough, the flow head being coupled to a rotor of the motor to be driven thereby in eccentric rotational motion;

a flow restrictor in fluid communication with the flow head, the flow restrictor comprising a plurality of ports permitting fluid communication therethrough, the flow restrictor being stationary with respect to the rotational motion of the flow head, wherein rotation of the flow head with respect to the flow restrictor causes the plurality of ports of the flow head to enter into and out of alignment with the plurality of ports of the flow restrictor such that fluid flow through the ports of the flow head and the flow restrictor is varied in an irregular pattern, the irregular pattern comprising a pattern in which an orientation of the flow head at a defined position in a cycle of the rotor is different between consecutive cycles of the rotor.

2. The drilling tool assembly of claim 1, wherein the flow head comprises a plurality of ports having at least two different cross-sectional areas, and the flow restrictor comprises a plurality of ports having at least two different cross-sectional areas.

3. The drilling tool assembly of claim 2, wherein the motor comprises a multi-lobe stator and a multi-lobe rotor, the multi-lobe stator having a different number of lobes than the multi-lobe rotor.

4. The drilling tool assembly of claim 3, wherein the flow head has a different number of ports than the flow restrictor.

5. The drilling tool assembly of claim 4, wherein the irregular pattern is dependent upon at least: a lobe ratio of the motor; a configuration of the plurality of ports of the flow head; and a configuration of the plurality of ports of the flow restrictor.

6. The drilling tool assembly of claim 4, wherein a lobe ratio of the rotor to the stator is 7:8.

7. The drilling tool assembly of claim 1, further comprising an inverter section in fluid communication with the motor, the motor being positioned between the inverter section and the flow head, the inverter section controlling axial movement in the drill string.

8. The drilling tool assembly of claim 1, wherein the flow restrictor comprises an insert between the flow head and the flow restrictor, the insert comprising ports permitting fluid communication between the flow head and ports of the flow restrictor.

9. The drilling tool assembly of claim 1, wherein the ports of the flow head and the ports of the flow restrictor are cylindrical.

10. A valve component for use in a drill string, the valve component comprising:

a flow head comprising a plurality of ports permitting fluid communication therethrough, the plurality of ports including ports of different sizes;

a flow restrictor comprising a plurality of ports permitting fluid communication therethrough, the plurality of ports including ports of different sizes;

the plurality of ports of the flow head being arranged such that eccentric rotation of the flow head with respect to the flow restrictor causes the plurality of ports of the flow head to enter into and out of alignment with the plurality of ports of the flow restrictor, such that when rotation of the flow head is driven by an eccentrically-driven rotor in the drill string, fluid flow through the ports of the flow head and the flow restrictor is varied in an irregular pattern, the irregular pattern comprising a pattern in which an orientation of the flow head at a defined position in a cycle of the rotor is different between consecutive cycles of the rotor.

11. The valve component of claim 10, wherein the sizes of the ports of the flow restrictor are different from the sizes of the ports of the flow head.

12. The valve component of claim 10, wherein the eccentrically-driven rotor is part of a motor having a multi-lobe rotor and a multi-lobe stator, the multi-lobe stator having a different number of lobes than the multi-lobe rotor.

13. The valve component of claim 12, wherein the flow head has a different number of ports than the flow restrictor.

14. The valve component of claim 13, wherein irregular pattern is dependent upon at least: a lobe ratio of the motor; a configuration of the plurality of ports of the flow head; and a configuration of the plurality of ports of the flow restrictor.

15. The valve component of claim 10, further comprising an insert between the flow head and the flow restrictor, the insert comprising ports permitting fluid communication between the flow head and ports of the flow restrictor.

16. The valve component of claim 10, wherein the eccentrically-driven rotor is a multi-lobe rotor comprised in a motor having a multi-lobe stator, the multi-lobe stator having a different number of lobes than the multi-lobe rotor.

17. A method of varying drilling fluid pressure in a drill string, the method comprising:

varying flow of the drilling fluid in the drilling string above a drilling tool of the drilling string in an irregular pattern, the irregular pattern being determined by flow of the drilling fluid through a flow head and a flow restrictor, the flow head being driven by a rotor in eccentric rotation with respect to the flow restrictor, each of the flow head and the flow restrictor comprising a plurality of ports, the plurality of ports in the flow head comprising different sizes and the plurality of ports in the flow restrictor comprising different sizes, wherein the flow of the drilling fluid is determined by alignment of the plurality of ports of the flow head with respect to the plurality of ports of the flow restrictor, the irregular pattern comprising a pattern in which an orientation of the flow head at a defined position in a cycle of the rotor is different between consecutive cycles of the rotor.

18. The method of claim 17, wherein a variation in flow of the drilling fluid induces a corresponding variation in pressure in the drill string.

19. The method of claim 17, wherein the flow head comprises a number of ports of at least two different sizes and the flow restrictor comprises a different number of ports of at least two different sizes, the at least two different sizes of the flow restrictor ports being different than the sizes of the flow head ports.

20. The method of claim 17, wherein the flow head comprises at least three ports and the flow restrictor comprises at least four ports, the rotor comprises a multi-lobe rotor that moves in eccentric motion in a multi-lobe stator, a lobe ratio of the rotor to the stator being 7:8.

* * * * *